US005533667A

United States Patent [19]

Gale

[11] Patent Number: 5,533,667

[45] Date of Patent: Jul. 9, 1996

[54] SEPARABLE MODULAR CONTAINERS

[75] Inventor: Gregory Gale, Napa, Calif.

[73] Assignee: PERF-PAK, Napa, Calif.

[21] Appl. No.: 532,939

[22] Filed: Sep. 22, 1995

[51] Int. Cl.[6] ..... B65D 5/42

[52] U.S. Cl. ..... 229/120.01; 220/23.2; 220/23.4

[58] Field of Search ..... 229/120.01, 120.011, 229/132; 220/23.2, 23.4, 23.8

[56] References Cited

U.S. PATENT DOCUMENTS

| | | | |
|---|---|---|---|
| 2,046,751 | 7/1936 | Reichel | 229/120.01 |
| 2,632,593 | 3/1953 | Minster, Jr. et al. | 220/23.4 |
| 2,651,449 | 9/1953 | Burnett | 229/120.01 |
| 2,737,334 | 3/1956 | Halgren | 229/120.01 |
| 2,855,135 | 10/1958 | Duval . | |
| 3,404,825 | 10/1968 | Rumberger | 229/120.01 |
| 3,519,194 | 7/1970 | Kohlhaas et al. . | |
| 3,592,344 | 7/1971 | Schade | 220/23.4 |
| 3,677,458 | 7/1972 | Gosling . | |
| 4,333,569 | 6/1982 | Hammacher | 229/120.01 |
| 4,550,834 | 11/1985 | Fletcher et al. . | |
| 4,566,626 | 1/1986 | Wood et al. . | |
| 4,804,137 | 2/1989 | Harby | 220/23.4 |
| 4,958,734 | 9/1990 | Wood et al. . | |
| 5,029,710 | 7/1991 | Workman et al. | 220/23.4 |
| 5,178,269 | 1/1993 | Evers | 229/120.011 |
| 5,299,733 | 4/1994 | Werth . | |
| 5,318,223 | 6/1994 | Gale . | |

FOREIGN PATENT DOCUMENTS

| | | | |
|---|---|---|---|
| 1486322 | 1/1969 | Germany | 229/120.011 |
| 2855564 | 7/1980 | Germany | 220/23.4 |
| 91-16240 | 10/1991 | WIPO . | |

*Primary Examiner*—Gary E. Elkins
*Attorney, Agent, or Firm*—Richard C. Litman

[57] ABSTRACT

Separable modular containers in the form of rectangular parallelepipeds are each formed from identical separate individual blanks of corrugated fiberboard or other sheet material, and include provision for separably securing at least two such containers together laterally. Each blank forms a separate, complete flat container adapted for lateral loading and to hold a single layer of canned goods or the like therein. Each container includes at least one specially formed connecting flap which is modified from one of the minor flaps of the container, which connecting flaps on two mating containers serve to secure opposite ends of the two containers together along adjacent sides. Another embodiment provides two connecting flaps per container, of which only one is needed for each container to be joined to a second container. Thus, the remaining connecting flaps may be used to connect additional containers in a multiple container flat.

19 Claims, 10 Drawing Sheets

SEPARABLE MODULAR CONTAINERS

FIELD OF THE INVENTION

The present invention relates generally to packaging, and more specifically to a modular construction of boxes wherein the specialized configuration of the blanks enable them to be folded and assembled as individual containers, or alternatively to be assembled together to form a flat of two or more boxes. The joined boxes are easily separated when desired. The present modular containers are particularly adapted for construction from corrugated sheet materials (e.g., fiberboard) and for use in the shipment and storage of canned goods and the like.

BACKGROUND OF THE INVENTION

Expendable, generally rectangular containers or boxes formed of corrugated fiberboard or the like, have been used in the shipping industry for many years. Such containers are particularly suitable for the packing, shipping, and storage of canned goods of various sorts, as well as other individually packaged products.

In the past, such canned goods were generally inserted within an open corrugated box from above, by means of automated top loading machinery. However, automated machinery which provides for the side loading or end loading of such containers has been developed more recently, which equipment is considered to be more efficient by many in the industry, and specialized containers have been developed accordingly for use with such side or end loading packaging machines.

Such machinery has a limitation in that it cannot stack cans or other contents to a height of two or more units, as is generally the case with top loading equipment. As a result, the volume of the containers used with such equipment is relatively limited by the single layer of cans or other goods which may be packaged therein, as enlarging the container horizontally leads to other limitations in handling. Moreover, larger boxes or containers would require very costly changes to the automated packaging equipment, which costs and complexity would generally be prohibitive in the packaging industry. Nevertheless, some means of separably securing single layer side or end loaded boxes or containers together, would provide additional efficiencies in shipping by securing a larger number of individual units together in a single package volume.

Thus, a need will be seen for separable modular containers which may be formed as individual, single layer side or end loaded boxes, but the flat pattern for which is also adapted to allow two or more such individual boxes to be removably joined together along a common side. The flat patterns for the boxes must be relatively simple and efficient, resulting in minimal losses during manufacturer and must provide for folding and construction of boxes therefrom, using conventional machinery with little or no modification. However, the boxes made from the flat patterns must also provide means for the interlocking of two or more such boxes together, as desired, and also for the easy separation of the boxes from one another when desired. The flat patterns for any specific box embodiment should be identical, in order to simplify the present box construction further.

DESCRIPTION OF THE PRIOR ART

U.S. Pat. No. 2,855,135 issued to Ernest H. Duval on Oct. 7, 1958 describes a Separable Twin Package wherein two joined display boxes are formed from a single blank. The boxes share common side and end walls which must be cut apart to separate the two boxes from one another. In contrast, the present invention comprises single boxes each formed from a single blank, which blanks are identical and each include means for joining together two or more boxes assembled from such blanks, if desired. Moreover, the present invention includes means providing for ease of separation of such joined boxes, if desired.

U.S. Pat. No. 3,519,194 issued to Frank A. Kohlhaas et al. on Jul. 7, 1970 describes an End-Loading Easy-Opening Shipping Carton wherein one edge of the carton is provided with an easily openable strip. When the strip is removed, the top of the carton may be lifted to expose the contents thereof. Other features provide further ease of opening the top of the container. While the side loading and top access of the Kohlhaas et al. carton is useful, it does not respond to the problem of joining multiple cartons, boxes or cases together for greater integrity in shipping, nor does it anticipate any need to provide for ease of separation of such joined containers, as provided by the present invention.

U.S. Pat. No. 3,677,458 issued to Dickinson Gosling on Jul. 18, 1972 describes an End Loading Twin Beverage Carton which uses a single blank to form two joined containers, unlike the individual boxes formed from each blank of the present invention. Moreover, the Gosling boxes are joined only along a single common edge, unlike the double connections at opposite sides of the present containers when joined.

U.S. Pat. No. 4,550,834 issued to Richard J. Fletcher et al. on Nov. 5, 1985 describes a Self-Erecting End-Load Top-Dispensing Container wherein each container is formed of a single blank, as in the present invention. The Fletcher container is essentially in the form of a "flat" wherein one layer of cans or other goods is contained therein, as in the case of the present container invention. Fletcher provides no means for removably securing two identical such containers together, however, as provided by the present invention.

U.S. Pat. No. 4,566,626 issued to Prentice J. Wood et al. on Jan. 28, 1986 describes an End Loading Can Carton, wherein upper and lower internal doubler sheets are glued or otherwise secured within the top and bottom surfaces of the carton. The function of these doubler sheets is to preclude major damage to the top and bottom surfaces of the single layer end loading carton, as may occur with vertical stacks of such cartons, and as such is beyond the scope of the present invention. Wood et al. do not anticipate the lateral joining of such flat cartons together, as provided by the present invention.

U.S. Pat. No. 4,958,734 issued to Prentice J. Wood et al. on Sep. 5, 1990 describes an End Loaded Carton Having A Triple Ply Wall, wherein end flaps of a secondary wall are folded inwardly to form a third ply. Generally overlapping arcuate separation lines are disclosed at one end of the assembled carton, but provide no means of connecting multiple cartons together, as provided by the present invention. The structure is related to the Wood et al. '626 patent described immediately above, and does not disclose any means of separably linking or joining multiple boxes, as provided by the present invention.

U.S. Pat. No. 5,299,733 issued to Elmer D. Werth on Apr. 5, 1994 describes a Detachable Multi-Unit Package With Flap, wherein the completed structure may be separated into either two or four separate boxes, as desired. The packaging is adapted for side or end loading, as provided by the present containers. However, each of the Werth multiple containers is formed from a single blank, whereas each container of the joined multiple containers of the present invention is formed from a separate blank. The present invention provides a convenient means of joining such separate containers together and also for the easy separation of such joined containers, as desired, whereas the Werth separable containers must initially be provided as a single structure including four joined box structures and cannot initially be provided separately.

U.S. Pat. No. 5,318,223 issued to Gregory W. Gale on Jun. 7, 1994 describes a Separable Modular Container wherein flap extensions of the major panels overlap one another to form a completed case assembly. The assembly is adapted for top loading, rather than end loading, and each individual carton of the case assembly is incomplete, in that each carton relies upon a portion of the major end flaps of the other carton for complete closure. Thus, each individual carton of the Gale '223 patent cannot be used separately, as provided by the separate box structures of the present invention.

Finally, PCT Patent Publication No. 91/16,240 to Elmer D. Werth and published on Oct. 31, 1991 describes a Detachable Multi-Unit Package. This publication describes essentially the same device as that of the Werth '773 patent discussed above, with the present invention having essentially the same distinctions over this PCT publication as over the '773 patent discussed above.

None of the above noted patents, taken either singly or in combination, are seen to disclose the specific arrangement of concepts disclosed by the present invention.

SUMMARY OF THE INVENTION

By the present invention, improved separable modular containers are disclosed.

Accordingly, one of the objects of the present invention is to provide improved separable modular containers which comprise separate individual containers each formed from a separate blank.

Another of the objects of the present invention is to provide improved separable modular containers each of which includes means for joining at least two like containers together.

Yet another of the objects of the present invention is to provide improved separable modular containers which means for joining containers together, includes means providing for ease of separation of joined containers.

Still another of the objects of the present invention is to provide improved separable modular containers which means for joining containers together may be adapted to secure only two containers together, or alternatively may provide for securing two or more containers together.

A further object of the present invention is to provide improved separable modular containers which means for joining containers together provides for the attachment of containers along their adjacent sides by means of opposed minor end flaps.

An additional object of the present invention is to provide improved separable modular containers which are adapted for lateral loading, as opposed to top loading.

Another object of the present invention is to provide improved separable modular containers each of which is in the general form of a rectangular parallelepiped when assembled and closed, and which may be constructed of corrugated fiberboard or other suitable sheet material, as desired.

A final object of the present invention is to provide improved separable modular containers for the purposes described which are inexpensive, dependable and fully effective in accomplishing their intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENTS

Referring now particularly to FIGS. 1 through 5 of the drawings, the present invention will be seen to relate to a construction for separable modular containers, wherein the containers may be joined together at opposing ends of adjacent side members, as desired. The present invention is particularly adapted to side or end loading fiberboard containers or boxes, and includes means providing for ease of separation of joined containers, as desired. FIGS. 1 through 5 disclose a first embodiment of the present invention, with FIGS. 6 through 10 disclosing a related second embodiment.

Figure 1:
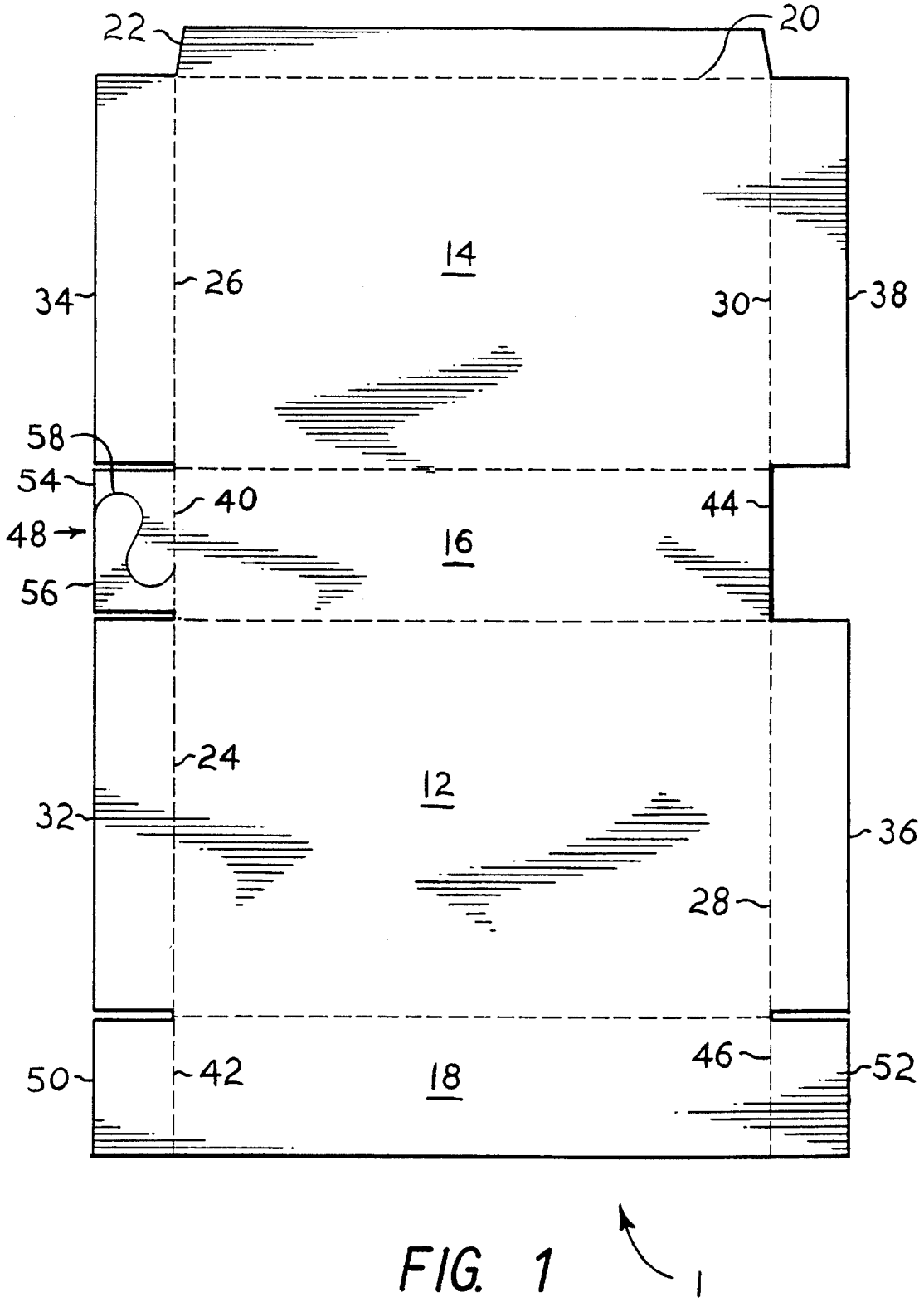
FIG. 1 is a plan view of a flat blank of sheet material which may be folded to form a first embodiment container of the present invention, including cut, fold, and score lines thereon.
Figure 3:
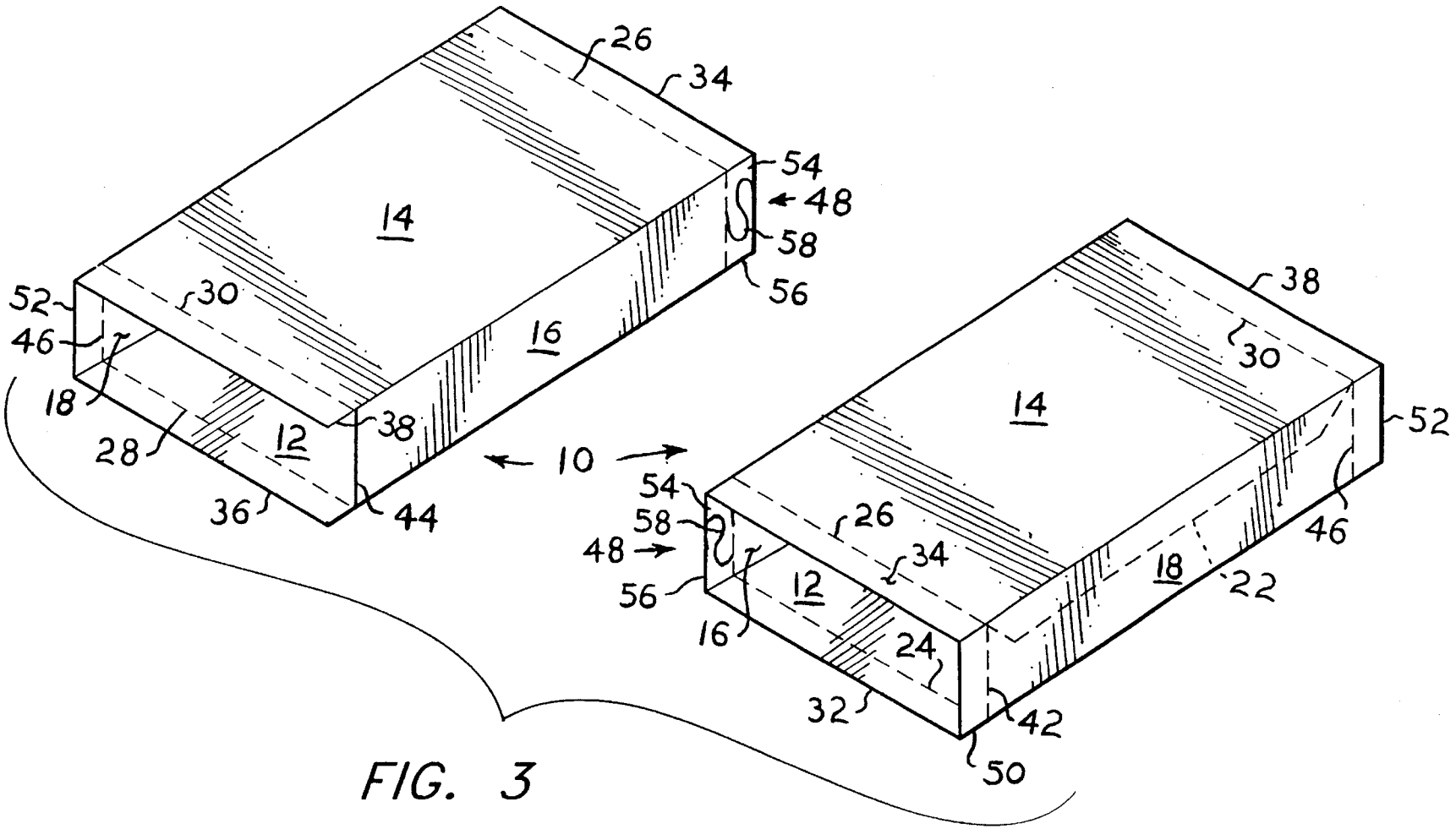
FIG. 3 is a perspective view of the containers of FIG. 2, with their respective top, bottom, and side panels closed.
Figure 4:
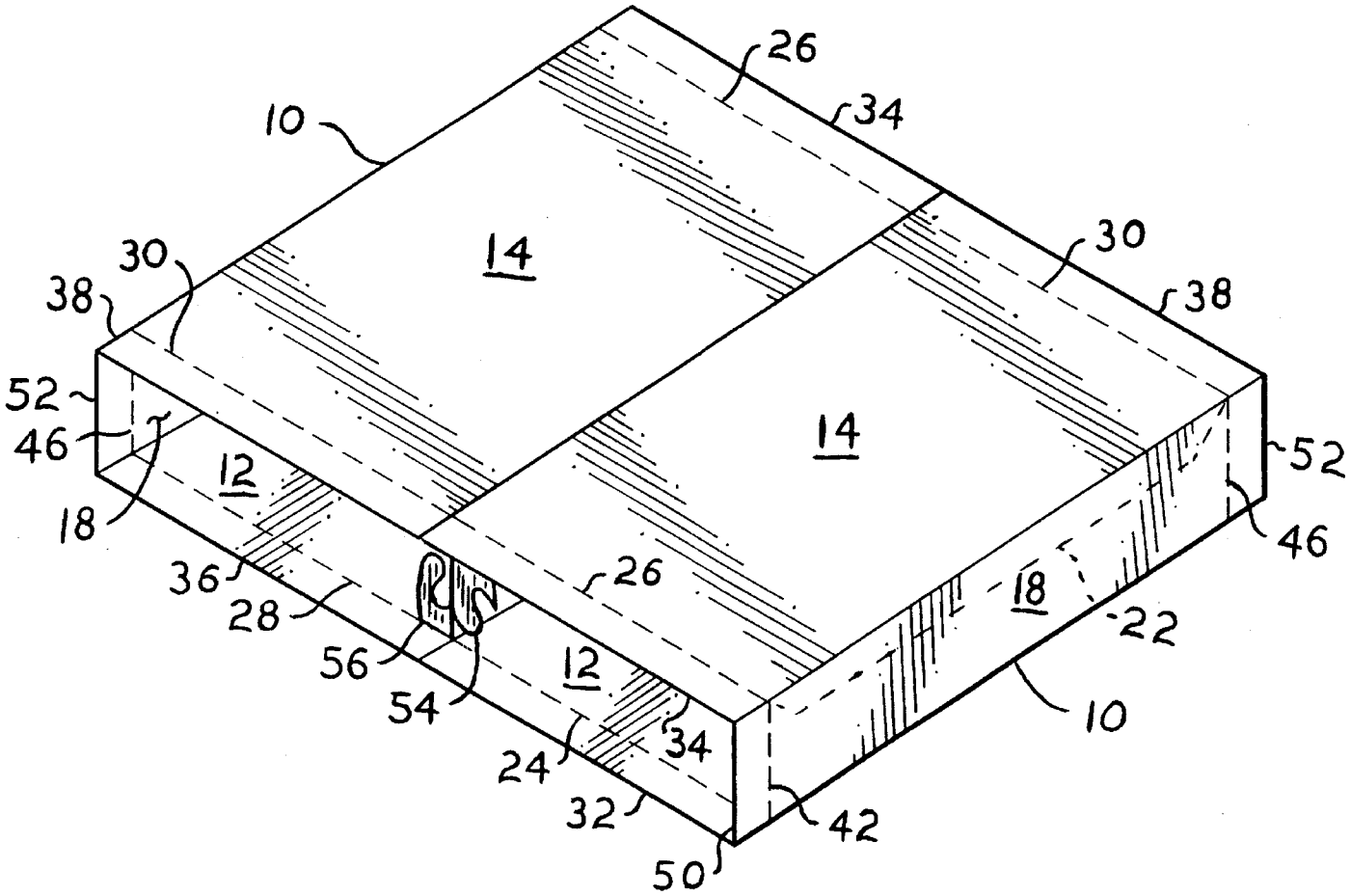
FIG. 4 is a perspective view of the two containers of FIG. 3 as they are joined together, showing the folding of one connecting flap end to provide for the joining of the containers.
Figure 5:
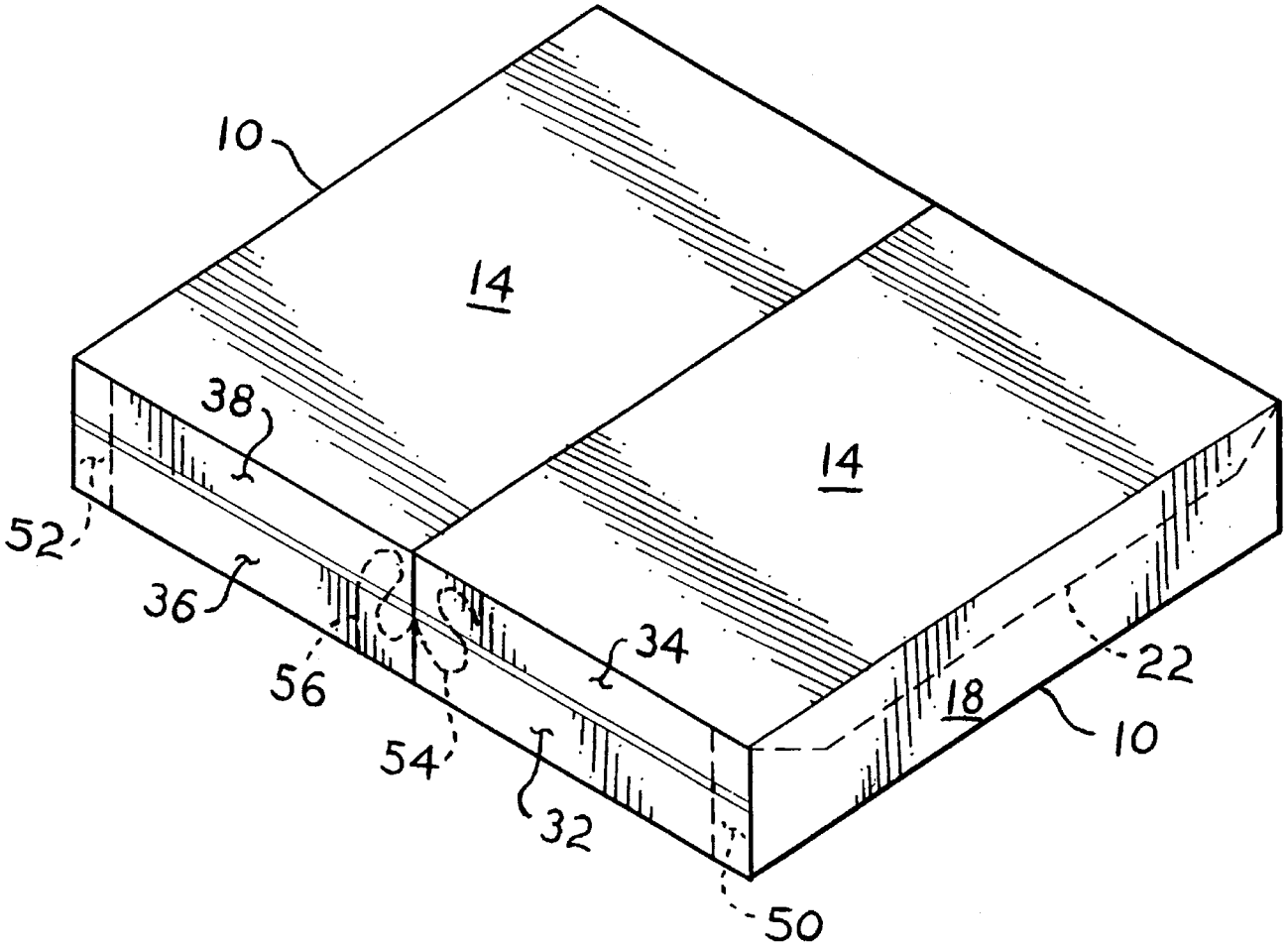
FIG. 5 is a perspective view of the joined containers of FIG. 4 in their completely assembled state, after closure.

FIG. 1 provides a plan view of the inner surface of a flat, unfolded box blank 1, which is used to form each of the boxes 10 shown in partially folded and completed states in FIGS. 2 through 5. The blank 1, and the boxes 10 formed from each blank 1, each include a bottom panel 12, an opposite top panel 14, a first side panel 16, and an opposite second side panel 18. Each of the top panels 14 includes a closure edge 20 opposite the fold or edge between the top panel 14 and adjoining first side panel 16, with the closure edge 20 having a closure panel 22 extending therefrom which is adhesively or otherwise secured to the second side panel 18 to partially close the box 10 structure. The dashed lines between each of the above panels 12 through 18 represent fold lines. The above construction, along with the end closure means described further below, form a box 10 having a rectangular parallelepiped configuration, two of which are shown in FIG. 5.

The bottom and top panels 12 and 14 each respectively have a first end 24 and 26, and an opposite second end 28 and 30, with each of these ends 24 through 30 having a major end flap, respectively 32 through 38, extending therefrom. The ends 24 through 30 of the top and bottom panels 12 and 14 are represented by dashed lines representing fold lines for the major end flaps 32 through 38, similar to the fold lines represented by the broken lines between panels 12 through 18 and discussed above. Similarly, the first and second side panels 16 and 18 each respectively have a first end 40 and 42, and an opposite second end 44 and 46, with the first end 40 of the first side panel 16 having a box connecting minor flap 48 extending therefrom and the first and second ends 42 and 46 of the second side panel 18 each having a minor end flap, respectively 50 and 52, extending therefrom.

It will be noted that the second end 44 of the first side panel 16 is devoid of any minor flap or other component extending therefrom, the reason for which will become apparent as the construction of the present box 10 and plural assembly thereof is explained further below. Also, the minor end flap 48 of the first side panel first end 40, will be seen to be divided into two separate components 54 and 56 by a cut or separation line 58 therebetween. This specialized, selectively connectable flap 48 provides for the joining together of two boxes 10 if such a multiple box configuration is desired, as will be described further below.

Figure 2:
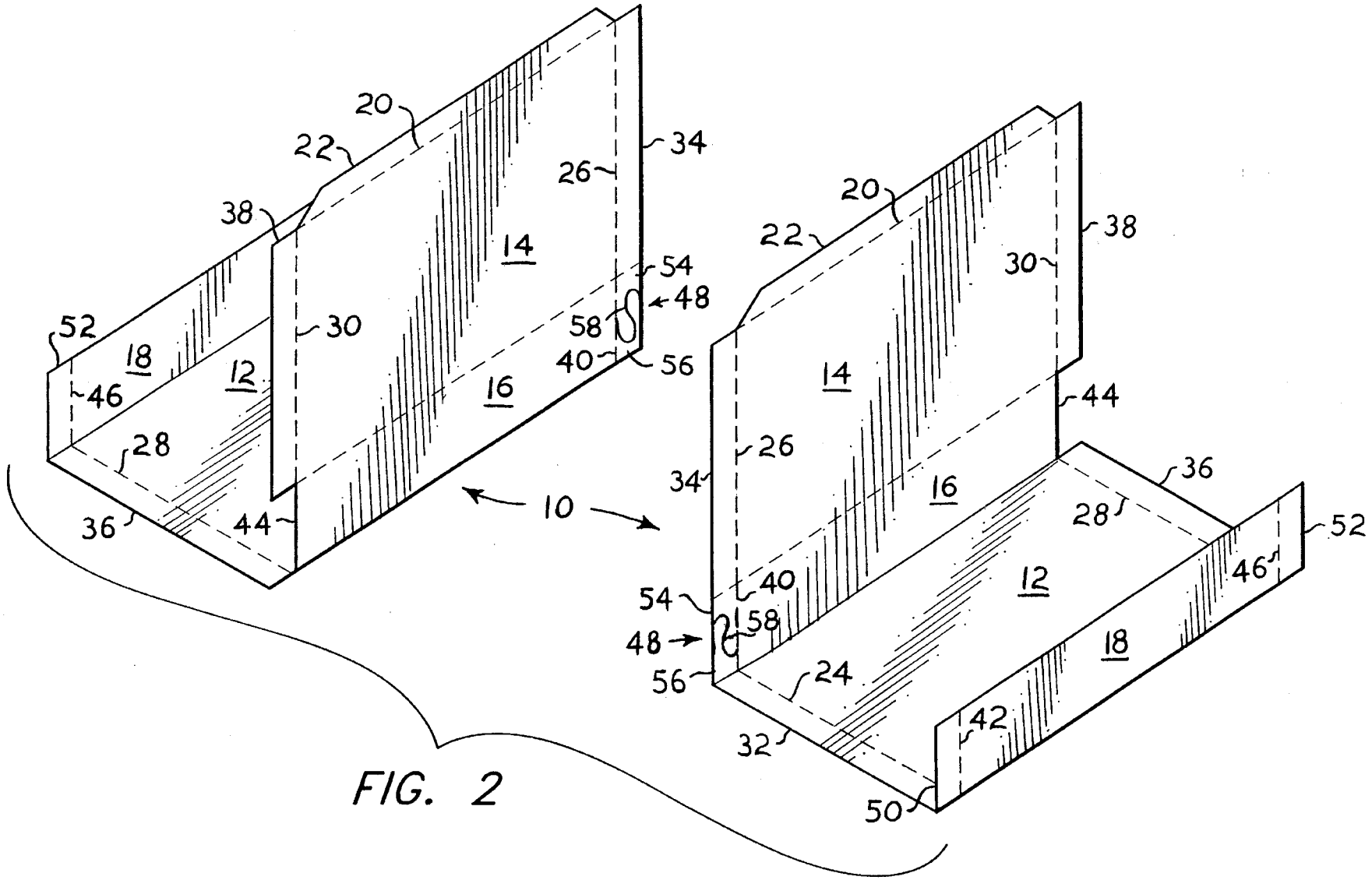
FIG. 2 is a perspective view of two like first embodiment containers of the present invention, each in a partially folded state and showing their relationship for joined assembly.

FIG. 2 provides a perspective view of a pair of partially constructed boxes 10, each formed from a blank 1 as shown in FIG. 1. In FIG. 2, each partially constructed box 10 has been folded along the respective lines between the bottom panel 12, and the first and second side panels 16 and 18o These two partially constructed boxes 10 have been placed relative to one another so that their respective first side panels 16 are facing one another, thus to place the first end components of each box 10 (including the box connecting minor flap 48) opposite the second end components of the opposite box 10.

FIG. 3 provides another perspective view as the assembly of the boxes 10 progresses further, with the top panel 14 of each box 10 being secured (adhesively, or otherwise) to the respective second side panel 18 by means of the respective closure flap 22 of each box 10. (The closure flap of the left hand box 10 in FIG. 3 is not visible, due to the left hand box 10 being turned around relative to the right hand box 10.) The result is a pair of partially closed rectangular box structures, each open at both ends.

To this point, either of the boxes 10 may be completely assembled as an individual closed structure, if desired, by folding their respective minor flaps 48 through 52 inwardly, and folding the respective major flaps 32 through 38 thereover. However, the two portion connecting minor flap 48 also provides for the connection of two such boxes 10 together, which process is shown further developed in FIG. 4.

In FIG. 4, the two boxes 10 are placed immediately adjacent one another, with the second portion 56 of the split connector minor flap 48 being folded outwardly relative to its respective box, along the separation cut 58; the first portion 54 is folded inwardly relative to its respective box. As noted above, the first side panel second end 44 is devoid of any minor flap or protrusion therefrom. As this area of each box is immediately adjacent the connector flap 48 of the other box in the two box assembly of FIGS. 2 through 5, it will be seen that the outwardly folded second portion 56 serves as a minor flap for the first side panel second end 44 of the opposite box, with the second end top and bottom major flaps 38 and 36 being folded thereover and secured thereto, as shown in FIG. 5, to complete the assembly. (As the two boxes 10 of FIGS. 4 and 5 are placed immediately adjacent one another, only one connecting flap assembly is shown in each of those figures. However, it will be understood that the same structure shown at one end of the boxes of FIGS. 4 and 5, is also provided at the opposite end, by the symmetrical nature of the assembly.) Thus, the two boxes 10 are secured together at opposite ends of their first side panels 16, by the outwardly folded second portion 56 of each connector flap 48 being secured beneath the respective major flaps 36 and 38 of the opposite box.

It will be seen that the shape of the separation line 58 between the first and second components 54 and 56 of the connector flap 48 is in the form of an "S" curve, or sinusoidal shape. This provides a relatively wider area for the outwardly folded second portion 56 of the connector flap 48, to be secured beneath the two half width major flaps 36 and 38 of the adjacent box 10. (As the two major flaps 36/38 and 32/34 at each end of a box 10 are substantially one half the width of the side panels 16/18, it will be seen that they do not overlap one another when folded, but are coplanar with the appropriate ends of each of the major flaps 36/38 being secured to a second portion 56 of the minor connector flap 48.) Other configurations for the two connector portions 54/56 may be provided as desired, e.g., an "L" shape with the shorter leg of the "L" for the outwardly folding portion connected to the side panel 16, to provide a sufficient gluing area for the two major flaps 36/38.

The present invention also provides for ease of separation of two joined boxes 10, if desired, by means of perforating, scoring, or otherwise weakening the line along the first end 40 of the first side panel 16, and separating the first side panel 16 from the connector minor flap 48. Thus, the relatively short portion of the perforated, scored, or otherwise weakened separation line 40 may be easily torn or separated to remove the outwardly folded second connecting component 56, which has been secured to the second box, from the first box with which it was originally formed, at each end 40 and 44 of the immediately adjacent first side panels 16 of the two boxes to separate the two boxes as desired.

The above described construction disclosed in FIGS. 1 through 5, will be seen to provide for the interlocking connection of two boxes 10 to one another, with each box providing a single outwardly folded connecting flap and the two box assembly requiring two such connecting flaps each at an opposite end of the adjacent sides of the connected boxes. Thus, no additional connectors or flaps are free to provide for the connection of such a two box assembly to additional boxes. FIGS. 6 through 10 disclose a second embodiment of the present invention, which responds to the above limitation. While it is anticipated that in many cases a two box assembly will be sufficient, the provision of two connecting minor flaps on each blank enables more than two boxes to be assembled together, to form an assembly comprising as many boxes as desired.

Figure 6:
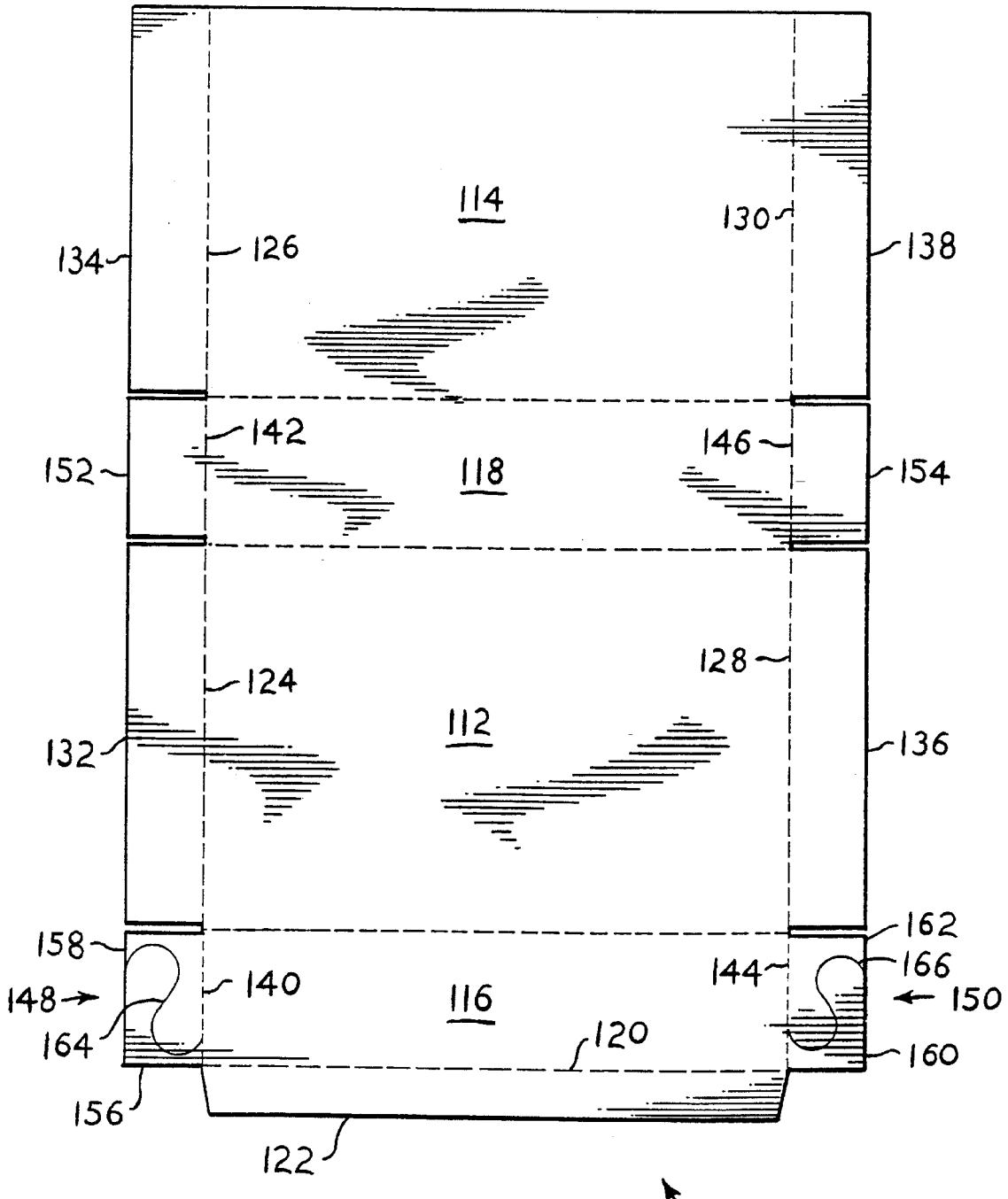
FIG. 6 is a plan view of a flat blank of sheet material which may be folded to form a second embodiment container of the present invention, including cut, fold, and score lines thereon.

In FIG. 6, a plan view of the inner surface of a second embodiment blank 101 is disclosed, with a blank 101 being used to form each of the boxes 110 disclosed in FIGS. 7 through 10 in various states. The blank 101 and boxes 110 formed therefrom are formed similarly to the blank 1 of FIG. 1 and boxes 10 of FIGS. 2 through 5, having a bottom panel 112, an opposite top panel 114, a first side panel 116, and an opposite second side panel 118.

(While the first side panel 16 of the blank 1 of FIG. 1 is located between the top and bottom panels 14 and 12, as opposed to the second side panel 118 being between the top/bottom panels 114/112 of the blank 101 of FIG. 6, it will be seen that this is merely a matter of nomenclature, and that by using this relationship for FIGS. 6 through 10, the interconnecting components may still be described as extending from the first side panel 116.)

A closure edge 120 extends along the first side panel 116, with a closure panel 122 extending therefrom and providing for the adhesive or other securing of the first side panel 116 to the top panel 114 to partially close the box 110 structure. (The closure panel 122 of the blank 101, and boxes 110 formed therefrom, is placed oppositely to the closure panel 22 of the embodiment of FIGS. 1 through 5. However, it will be seen that either configuration may be used in either embodiment.) The dashed lines between each of the above panels 112 through 118 represent fold lines, just as in the first embodiment of FIGS. 1 through 5. The above construction, along with the end closure means described further below, form a box 110 having a rectangular parallelepiped configuration as in the first embodiment pair shown in FIG. 5, but providing for the assembly of additional boxes 110 together.

The bottom and top panels 112 and 114 each respectively have a first end 124 and 126, and an opposite second end 128 and 130, with each of these ends 124 through 130 having a major end flap, respectively 132 through 138, extending therefrom. The ends 124 through 130 of the top and bottom panels 112 and 114 are represented by dashed lines representing fold lines for the major end flaps 132 through 138, similar to the fold lines represented by the broken lines between panels 112 through 118 and discussed above. Similarly, the first and second side panels 116 and 118 each respectively have a first end 140 and 142, and an opposite second end 144 and 146, with the first and second ends 140 and 144 of the first side panel 116 each having a box connecting minor flap, respectively 148 and 150, extending therefrom and the first and second ends 142 and 146 of the second side panel 118 each having a minor end flap 152 and 154, extending therefrom.

Each of the minor end flaps 148 and 150 of the first side panel 116 will be seen to be divided into two separate components, respectively 156 and 158 for the first connector flap 148 and 160 and 162 for the second connector flap 150. These components are separated by a cut or separation line, respectively 164 for the first flap 148 and 166 for the second flap 150. These specialized, selectively connectable flaps 148 and 150 provide for the joining together of two or more boxes 110 if such a multiple box configuration is desired, as will be described further below. It should again be noted that the multiple box connection provided by the blank 101 of FIG. 6 and the resulting boxes 110 of FIGS. 7 through 10, are not limited to only a two box assembly, as in the boxes 10 of the first embodiment of FIGS. 2 through 5.

Figure 7:
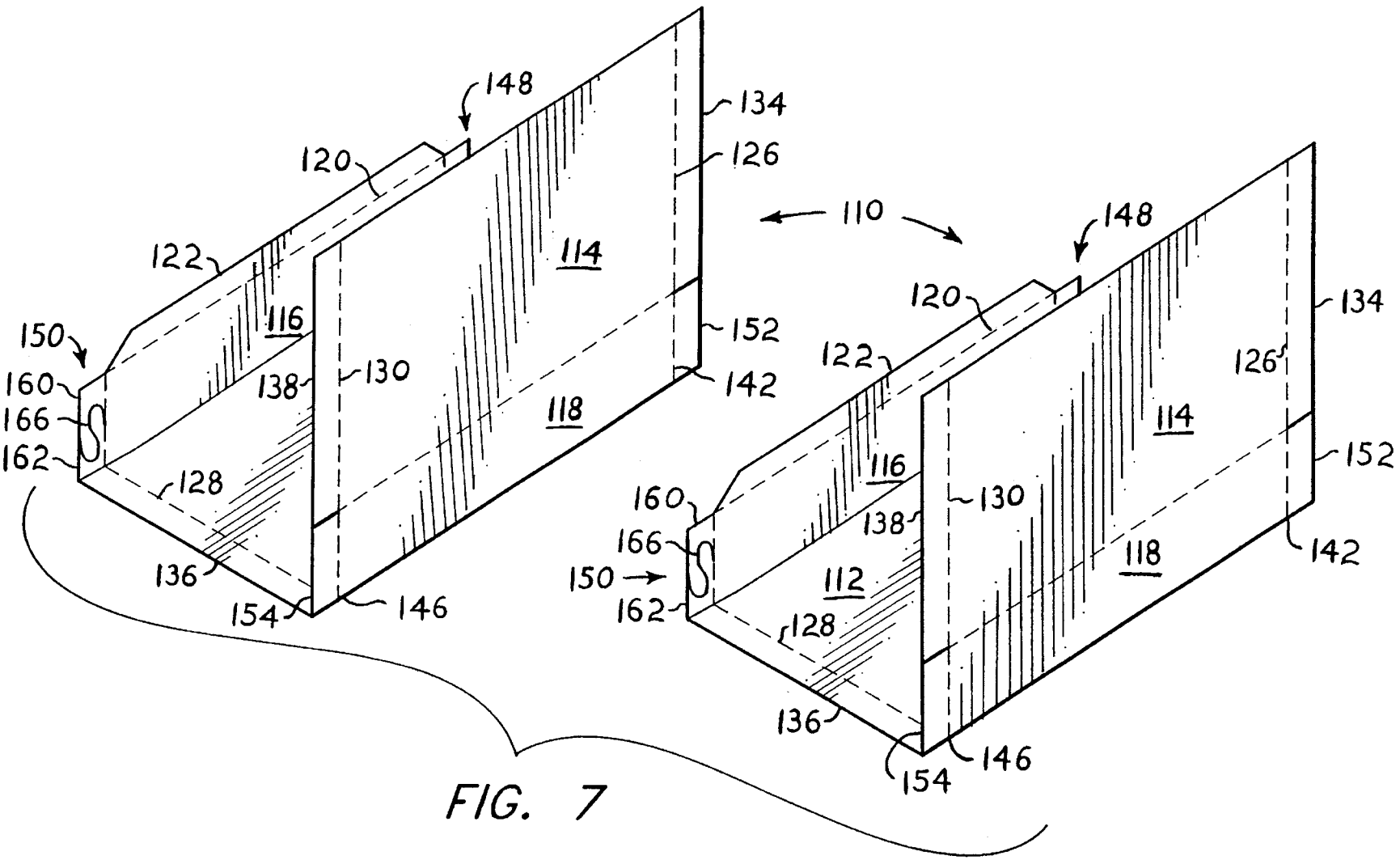
FIG. 7 is a perspective view of two like second embodiment containers of the present invention, each in a partially folded state and showing their relationship for joined assembly.

FIG. 7 provides a perspective view of a pair of partially constructed boxes 110, each formed from a blank 101 as shown in FIG. 6. In FIG. 7, each partially constructed box 110 has been folded along the respective lines between the bottom panel 112, and the first and second side panels 116 and 118. It will be noted, however, that the two boxes 110 of FIGS. 7 through 10 are not oriented as are the boxes 10 of FIGS. 2 through 5, but are turned to face in the same direction, i.e., with the first side panel 116 of one box directly facing the second side panel 118 of the next box. As the boxes 110 are turned, the second ends are shown to the front portion of the perspective FIGS. 7 through 10. It will be further understood that although only two boxes 110 are shown in FIGS. 7 through 10, that any number of additional boxes 110 could be joined together, with the first side panel 116 of one box being placed adjacent the second side panel 118 of the next box, and continuing in such a configuration so long as desired.

Figure 8:
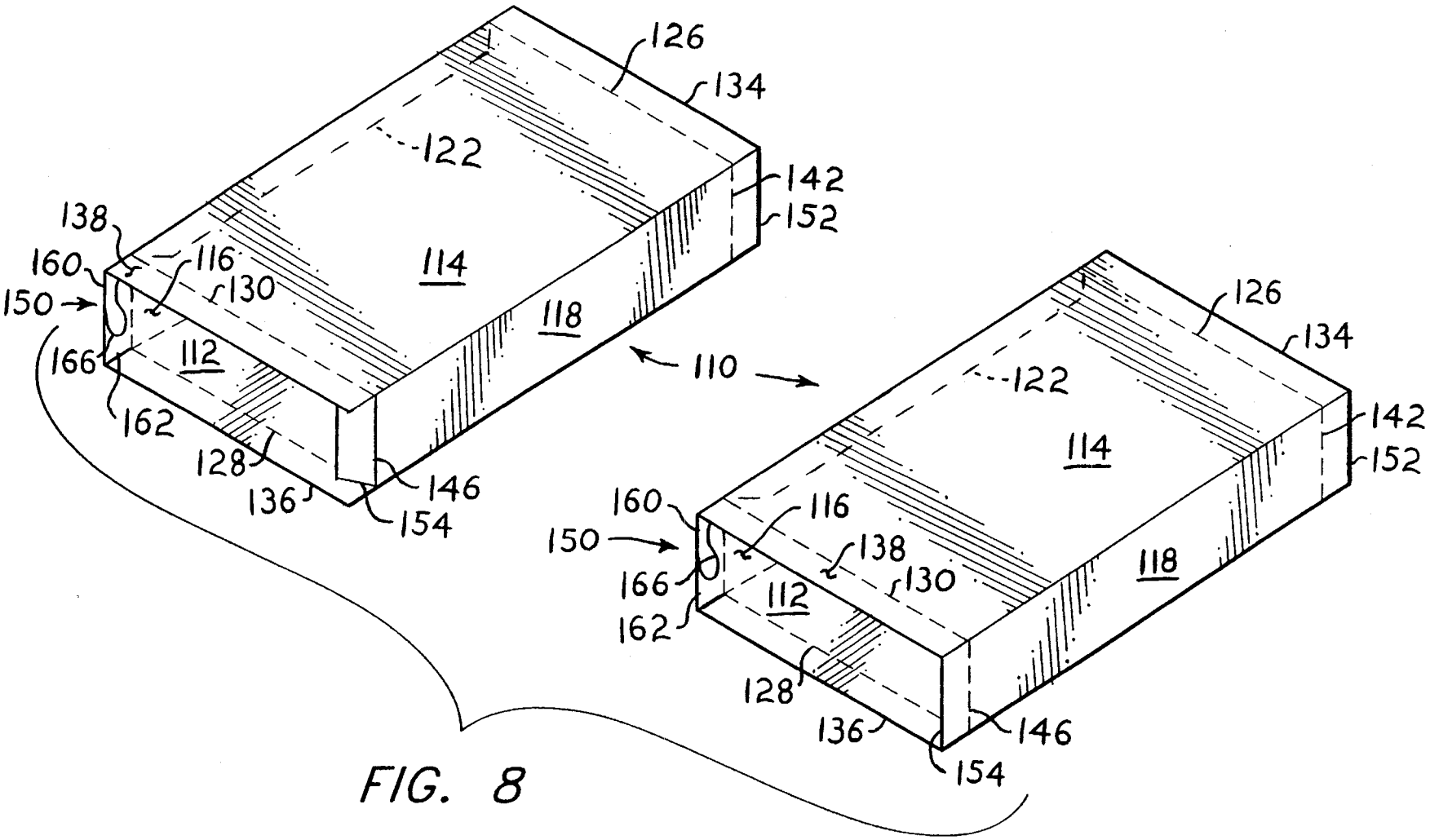
FIG. 8 is a perspective view of the containers of FIG. 7, with their respective top, bottom, and side panels closed.

FIG. 8 provides another perspective view as the assembly of the boxes 110 progresses further, with the top panel 114 of each box 110 being secured (adhesively, or otherwise) to the respective first side panel 116 by means of the respective closure flap 122 of each box 110. The result is a pair of partially closed rectangular box structures, each open at both ends.

As in the case of the boxes 10 of FIGS. 2 through 5, up to this point any of the boxes 110 may be completely assembled as an individual closed structure if desired, by folding their respective minor flaps 148 through 154 inwardly, and folding the respective major flaps 132 through 138 thereover. However, the two connecting flaps 148 and 150, with their respective separable portions 156 through 162, also provide for the connection of two or more such boxes 110 together, as shown further developed in FIG. 9.

Figure 9:
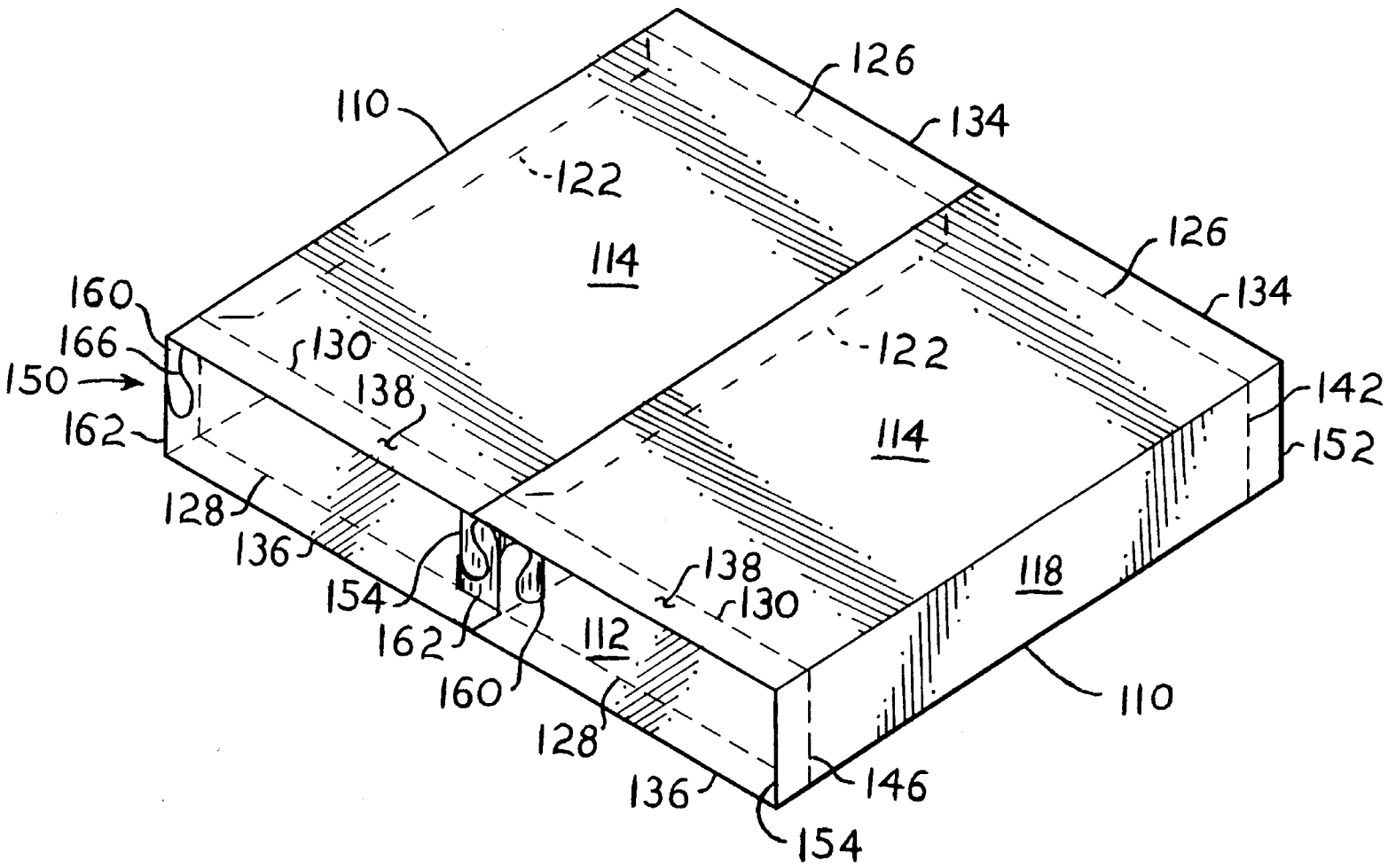
FIG. 9 is a perspective view of the two containers of FIG. 8 as they are joined together, showing the folding of one connecting flap end to provide for the joining of the containers.

In FIG. 9, two boxes 110 are placed immediately adjacent one another, with the second portion 162 of the split connector minor flap 150 being folded outwardly relative to its respective box, along the separation cut 166; the first portion 160 is folded inwardly relative to its respective box. (It will be understood that the configuration of the first minor connecting flap 148 which is not visible in FIG. 9, is symmetrical to the connecting flap 150. Also, it will be noted that in this second embodiment, the second portion 158 and 162 of each of the connector flaps 148 and 150 has a greater common length with the first side panel 116, than does each of the first portions 156 and 160. This may be desirable to provide a greater length of connecting material between connected boxes 110, or alternatively the connecting portion having a shorter joined length may be used to connect the boxes 110, as shown in the first embodiment.)

Figure 10:
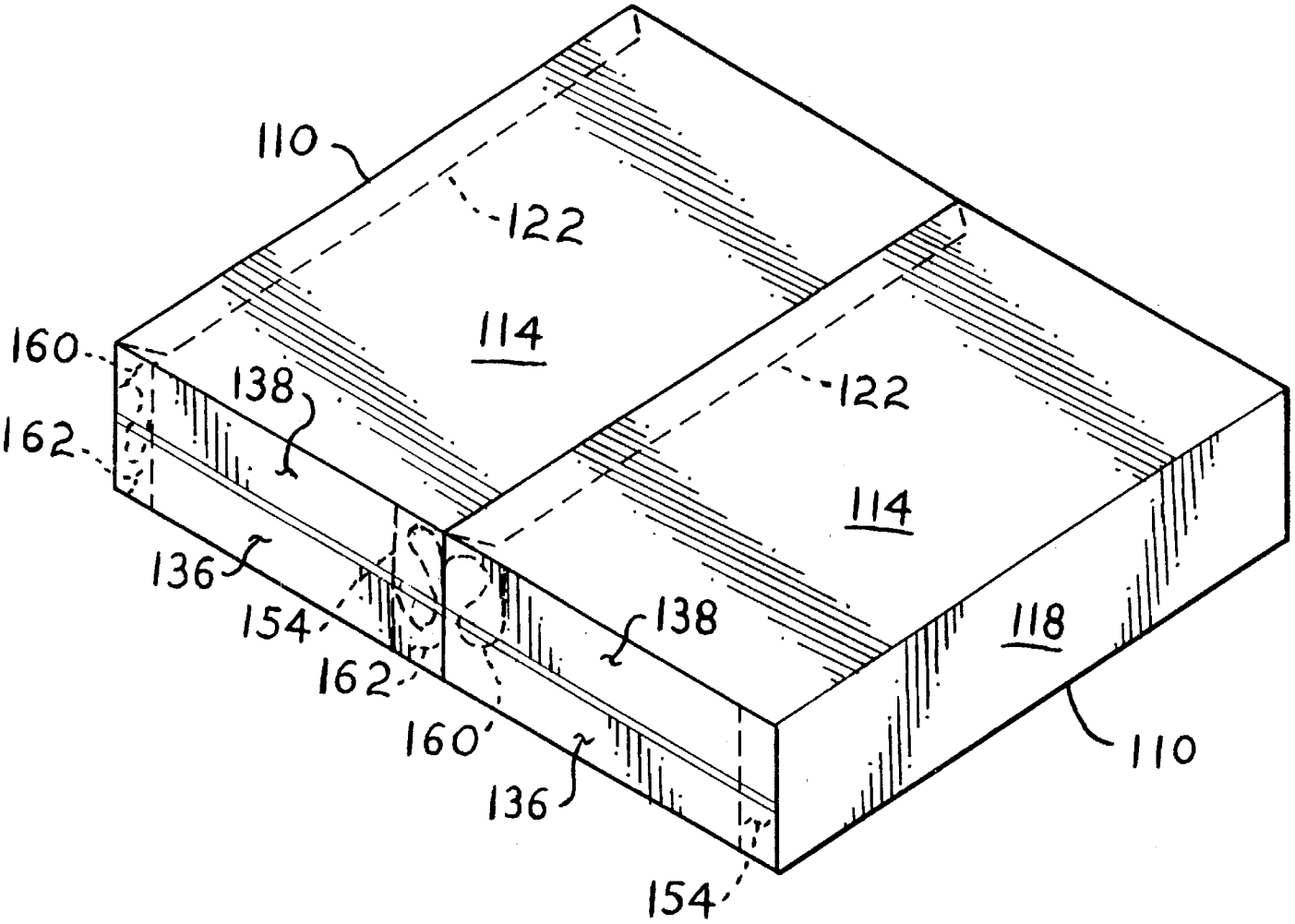
FIG. 10 is a perspective view of the joined containers of FIG. 9 in their completely assembled state, after closure.

Unlike the boxes 10 of the first embodiment, each end of each of the side panels includes a minor flap 148, 150, 152, or 154 extending therefrom. Thus, the outwardly folded connecting portion of each of the connecting minor flaps, e.g., portions 158 and 162, will overly a corresponding inwardly folded minor flap, respectively 152 and 154, of an adjacent connected box 110. An example of this structure is shown in FIG. 9 by the first side panel second end minor flap 154 and the overlying second portion 162 of the connecting minor flap 150. The two major flaps 136 and 138 of the leftmost box of FIG. 9 are then folded over the inwardly turned minor flaps 154, and one or both portions 160 and 162 of the leftmost connector flap 150, depending upon whether or not a third box is connected thereto, and the outwardly folded portion 162 of the right hand box 110, to close and connect the joined boxes. This completed multiple box structure is shown in FIG. 10.

As in the case of the first embodiment boxes of FIGS. 2 through 5, the major flaps 132 through 138 are substantially half the width of the side panels 116 and 118, so as to be coplanar when folded to close the box structure. Also, as with the boxes 10 of the first embodiment, the sinusoidal separation line 164/166 between the two portions of each of the connector flaps 148/150, may be of any suitable alternative shape which provides sufficient area for the securing of the overlying ends of the major flaps thereto, e.g., an "L" shape as described for the first embodiment, etc. The important point to note here is that there be sufficient surface area provided by the outwardly folded portion of the connector flap to provide for the gluing or other securing of the overlying ends of the major flaps thereto.

As in the case of the first embodiment of FIGS. 1 through 5, the second embodiment of the present invention also provides for ease of separation of two joined boxes 110, if desired, by means of perforating, scoring, or otherwise weakening the line along the first ends 140 and 144 of the first side panel 116, and separating the first side panel 116 from the connector minor flaps 148 and 150 at each end thereof. Thus, the relatively short portion of the perforated, scored, or otherwise weakened separation lines 140 and 144 may be easily torn or separated to remove the outwardly folded second connecting components 158 and 162, which have been secured to the second box, from the first box with which it was originally formed, at each end 140 and 144 of the immediately adjacent first side panels 116 of the two boxes to separate the two boxes as desired.

In summary, the present separable modular containers will be seen to provide selectively connectable and/or separable boxes, as desired, using a single, easily formed blank for each individual box. The separable portions of the connecting flap or flaps of the different embodiments may both be folded inwardly to form separate box structures, if desired, or alternatively one of the separable portions may be folded outwardly before closure of the boxes, and secured beneath the major flaps of an adjoining box after the boxes have been filled. The perforating or weakening of the line dividing at least the outwardly folded portion of the connecting flap(s) of each box, enables joined boxes to be separated from one another easily as desired when the occasion arises. While the configuration of the first embodiment blank provides for the connection of only two boxes together, the second embodiment blank enables any number of boxes formed therefrom, to be connected.

While the present blanks and boxes formed therefrom may be made of any suitable sheet material, fiberboard, and preferably corrugated fiberboard, has been found to be most suitable for the intended use of the present containers or boxes. The present boxes are particularly adapted for side or end loading (or more generally, lateral loading) therein, and as such preferably have a length and width substantially greater than their height, which is adapted for only a single layer of cans or other goods therein. In any case, either of the embodiments is configured for conventional lateral loading, with the connection of adjacent boxes being provided merely by outwardly folding one portion of the connecting flap(s) on each box, as desired and as described above. Later ease of separation is provided by perforating or otherwise weakening the line between the side panel and the attached connecting flap. The result is an extremely versatile separable modular container which will be seen to have innumerable uses in the container industry.

It is to be understood that the present invention is not limited to the sole embodiments described above, but encompasses any and all embodiments within the scope of the following claims.

I claim:

1. A pair of selectively joinable and separable modular containers, comprising:

a first box and an identical second box each adapted for lateral loading and each formed of a single blank of sheet material and each having a generally rectangular parallelepiped configuration;

each said box including a bottom panel, an opposite top panel, a first side panel, and an opposite second side panel, with said top panel of each said box having a closure edge with a closure panel extending therefrom and respectively secured to said second side panel of each said box;

said bottom panel and said top panel of each said box each including a first end and an opposite second end, with each said end of each said top panel and each said bottom panel having a major end flap extending therefrom;

said first side panel and said second side panel of each said box each including a first end and an opposite second end, with at least one said end of each said side panel including a minor end flap extending therefrom, and;

at least one said minor end flap of said first side panel of each said box comprising a separable selectively connectable connector flap having an inwardly foldable portion and a separate selectively outwardly foldable portion, with each said selectively outwardly foldable portion adapted to secure said first box selectively to said second box with said first side panel of each said box disposed immediately adjacent one another, with said selectively outwardly foldable portion of said connector flap of said first box being selectively secured beneath each said major end flap of each said second end of said top panel and said bottom panel of said second box, and said selectively outwardly foldable portion of said connector flap of said second box being selectively secured beneath each said major end flap of each said second end of said top panel and said bottom panel of said first box so that said first box and said second box are selectively and separably secured to one another at each said end of each said side panel, whereby;

each said box is selectively secured to one another by means of securing said outwardly foldable portion of said connector flap of said second box beneath each said major end flap of each said second end of said top panel and said bottom panel of said first box, said first and said second box are filled as desired, and said outwardly foldable portion of said connector flap of said first box is secured beneath each said major end flap of each said second end of said top panel and said bottom panel of said second box to form a pair of separable modular containers selectively and separably joined at each said opposite end of each said first side panel of each said box by means of each said selectively outwardly folding portion of each said connector flap.

2. The separable modular containers of claim 1, including:

separation means disposed along a line between said first side panel and said outwardly foldable portion of said selectively connectable flap of each said box.

3. The separable modular containers of claim 2, wherein:

each said separation means comprises a line of perforations.

4. The separable modular containers of claim 1, wherein:

said connector flap of each said box includes a sinusoidally curved separation line between said inwardly foldable portion and said selectively outwardly foldable portion thereof.

5. The separable modular containers of claim 1, wherein:

said second end of said first side panel of each said box is devoid of any panel extending therefrom.

6. The separable modular containers of claim 1, wherein:

each said side panel of each said box has a height and each said major end flap of each said box has a width substantially one half said height of each said side panel, with each said major end flap extending from said top panel first end and said bottom panel first end of each said box being coplanar, and each said major end flap extending from said top panel second end and said bottom panel second end of each said box being coplanar, when said box is closed.

7. The separable modular containers of claim 1, wherein:

each said box has a length, a width, and a height, with said length and said width each being substantially greater than said height for each said box.

8. The separable modular containers of claim 1, wherein:

each said box is assembled and selectively secured to one another using adhesive means.

9. The separable modular containers of claim 1, wherein:

each said box is formed of fiberboard material.

10. The separable modular containers of claim 1, wherein:

each said box is formed of corrugated fiberboard material.

11. The separable modular containers of claim 1, wherein:

each of said boxes is assembled and selectively secured to one another using adhesive means.

12. A plurality of selectively joinable and separable modular containers, comprising:

a plurality of identical boxes each adapted for lateral loading and each formed of a single blank of sheet material and each having a generally rectangular parallelepiped configuration;

each of said boxes including a bottom panel, an opposite top panel, a first side panel, and an opposite second side panel, with said first side panel of each of said boxes having a closure edge with a closure panel extending therefrom and respectively secured to said top panel of each of said boxes;

said bottom panel and said top panel of each of said boxes each including a first end and an opposite second end, with each said end of each said top panel and each said bottom panel having a major end flap extending therefrom;

said first side panel and said second side panel of each of said boxes each including a first end and an opposite second end, with each said end of each said side panel respectively including a minor end flap extending therefrom, and;

each said minor end flap of said first side panel of each of said boxes comprising a first and a second separable selectively connectable flap having an inwardly foldable portion and a separate selectively outwardly foldable portion, with each said selectively outwardly foldable portion adapted to secure one of said boxes selectively to another of said boxes with said first side panel of said one of said boxes disposed immediately adjacent said second side panel of said another of said boxes, with said selectively outwardly foldable portion of said first connectable flap of said one of said boxes being selectively secured respectively beneath each said major end flap of said first end of said top panel and said first end of said bottom panel of said another of said boxes, and said selectively outwardly foldable portion of said second connectable flap of said one of said boxes being selectively secured beneath each said major end flap of each said second end of said top panel and said bottom panel of said another of said boxes so that said one of said boxes and said another of said boxes are selectively and separably secured to one another at each said end of each said side panel, and;

continuing to secure additional said boxes selectively together as desired in the manner recited above, with said first side panel of each of said boxes being disposed immediately adjacent said second side panel of an adjacent one of said boxes, whereby;

each of said boxes is selectively secured to one another by means of securing said outwardly foldable portion of said second connector flap of each of said boxes beneath each said major end flap of each said second end of said top panel and said bottom panel of said adjacent one of said boxes, said boxes are filled as desired, and said outwardly foldable portion of said first connector flap of each of said boxes is secured beneath each said major end flap of each said first end of said top panel and said bottom panel of said adjacent one of said boxes to form a plurality of separable modular containers selectively and separably joined at each said opposite end of each said first side panel and adjacent said second side panel of each of said boxes by means of each said selectively outwardly folding portion of each said connector flap.

13. The separable modular containers of claim 12, including:

separation means disposed along a line between said first side panel and said outwardly foldable portion of each said selectively connectable flap of each of said boxes.

14. The separable modular containers of claim 13, wherein:

each said separation means comprises a line of perforations.

15. The separable modular containers of claim 12, wherein:

each said connector flap of each of said boxes includes a sinusoidally curved separation line between said inwardly foldable portion and said selectively outwardly foldable portion thereof.

16. The separable modular containers of claim 12, wherein:

each said side panel of each of said boxes has a height and each said major end flap of each of said boxes has a width substantially one half said height of each said side panel, with each said major end flap extending from said top panel first end and said bottom panel first end of each of said boxes being coplanar, and each said major end flap extending from said top panel second end and said bottom panel second end of each of said boxes being coplanar, when each of said boxes is closed.

17. The separable modular containers of claim 12, wherein:

each of said boxes has a length, a width, and a height, with said length and said width each being substantially greater than said height for each of said boxes.

18. The separable modular containers of claim 12, wherein:

each of said boxes is formed of fiberboard material.

19. The separable modular containers of claim 12, wherein:

each of said boxes is formed of corrugated fiberboard material.

* * * * *